US011191349B2

(12) United States Patent
Nanda

(10) Patent No.: US 11,191,349 B2
(45) **Date of Patent: *Dec. 7, 2021**

(54) ILLUMINATED FLASHING TOOTHBRUSH AND METHOD OF USE

(71) Applicant: Ranir, LLC, Grand Rapids, MI (US)

(72) Inventor: Puneet Nanda, Cerritos, CA (US)

(73) Assignee: Ranir, LLC, Grand Rapids, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/232,643

(22) Filed: Apr. 16, 2021

(65) Prior Publication Data

US 2021/0227966 A1 Jul. 29, 2021

Related U.S. Application Data

(63) Continuation of application No. 16/141,550, filed on Sep. 25, 2018, which is a continuation of application No. 14/804,255, filed on Jul. 20, 2015, now Pat. No. 10,085,549, which is a continuation of application No. 14/505,280, filed on Oct. 2, 2014, now Pat. No. 9,084,473, which is a continuation of application No. 14/263,567, filed on Apr. 28, 2014, now Pat. No. 9,060,596, which is a continuation of application No. 13/890,183, filed on May 8, 2013, now Pat. No.

(Continued)

(51) Int. Cl.
*A46B 15/00* (2006.01)
*A46B 9/04* (2006.01)

(52) U.S. Cl.
CPC ..... *A46B 15/0036* (2013.01); *A46B 9/04* (2013.01); *A46B 15/0002* (2013.01); *A46B 15/0008* (2013.01); *A46B 15/0044* (2013.01); *A46B 2200/1066* (2013.01)

(58) Field of Classification Search
CPC ..... A46B 15/0036; A46B 15/0002; A46B 15/0008; A46B 15/0044; A46B 9/04; A46B 2200/1066
See application file for complete search history.

(56) References Cited

U.S. PATENT DOCUMENTS 1,899,242 A 2/1933 McNab
2,108,692 A 2/1938 Pieck
(Continued)

FOREIGN PATENT DOCUMENTS

CN 2633081 8/2004
CN 03266969.0 8/2004
(Continued)

OTHER PUBLICATIONS

International Search Report and Written Opinion for International Application No. PCT/US2008/060121; dated Jun. 23, 2008.
(Continued)

*Primary Examiner* — Weilun Lo
(74) *Attorney, Agent, or Firm* — Warner Norcross + Judd LLP

(57) ABSTRACT

A toothbrush can include a handle and a head. At least one bristle can be attached to the head. The toothbrush can also have an illumination member, an illumination circuit and an activation device. A pliant base on the handle can be used to activate the activation device to initiate the illumination circuit.

27 Claims, 11 Drawing Sheets

Related U.S. Application Data

8,707,500, which is a continuation of application No. 13/620,717, filed on Sep. 15, 2012, now Pat. No. 8,561,244, which is a continuation of application No. 13/350,583, filed on Jan. 13, 2012, now Pat. No. 8,327,491, which is a continuation of application No. 13/105,582, filed on May 11, 2011, now Pat. No. 8,413,286, which is a continuation-in-part of application No. 11/734,732, filed on Apr. 12, 2007, now Pat. No. 8,006,342.

(60) Provisional application No. 61/381,856, filed on Sep. 10, 2010.

(56) References Cited

U.S. PATENT DOCUMENTS 2,810,797 A 10/1957 Gulnick
3,019,572 A 2/1962 Berry et al.
3,324,997 A 6/1967 Bonanno
3,783,364 A 1/1974 Gallanis et al.
3,884,635 A 5/1975 Sloan
3,894,550 A 7/1975 Eaton
4,054,026 A 10/1977 Goodrich
4,149,156 A 4/1979 Blasucci
4,154,997 A 5/1979 Grebner et al.
4,188,717 A 2/1980 Mansfield
4,214,657 A 7/1980 Winston
4,361,408 A 11/1982 Wirtschafter
4,419,016 A 12/1983 Zoltan
4,448,541 A 5/1984 Wirtschafter
4,450,599 A 5/1984 Scheller et al.
4,476,604 A 10/1984 White et al.
4,485,796 A 12/1984 Boyer
4,779,173 A 10/1988 Carr et al.
4,780,924 A 11/1988 Hansen et al.
4,788,734 A 12/1988 Bauer
4,836,415 A 6/1989 Grussmark
4,845,796 A * 7/1989 Mosley ..... A61C 17/26 15/23
4,866,807 A 9/1989 Kreit et al.
4,875,147 A 10/1989 Auer
4,886,807 A 12/1989 Kitamura et al.
4,974,423 A 12/1990 Pring
4,991,755 A 2/1991 Grusmark
5,000,376 A 3/1991 Wojdyla
D317,718 S 6/1991 Carol
5,030,090 A 7/1991 Maeda et al.
5,044,037 A 9/1991 Brown
5,068,939 A 12/1991 Holland
5,072,477 A 12/1991 Pai
5,118,355 A 6/1992 Browning
5,135,485 A 8/1992 Cohen et al.
5,154,917 A 10/1992 Ibrahim et al.
5,160,194 A 11/1992 Feldman
5,259,086 A 11/1993 Fong
5,305,490 A 4/1994 Lundgren
5,306,151 A 4/1994 Rauch
5,313,439 A 5/1994 Albeck
5,339,479 A 8/1994 Lyman
5,369,835 A 12/1994 Clarke
5,371,915 A 12/1994 Key
5,372,501 A 12/1994 Shalvi
5,382,107 A 1/1995 Nian
5,438,726 A 8/1995 Leite
5,457,665 A 10/1995 Reid
5,485,646 A 1/1996 Merritt
5,517,713 A 5/1996 Hadcock
5,561,881 A 10/1996 Klinger et al.
5,572,762 A 11/1996 Scheiner
5,625,916 A 5/1997 McDougall
5,629,527 A 5/1997 Levit et al.
5,673,451 A 10/1997 Moore et al.
5,742,971 A 4/1998 Salinger
5,746,348 A 5/1998 Bloom
5,751,661 A 5/1998 Walters
5,784,743 A 7/1998 Shek
5,801,637 A 9/1998 Lomholt
5,813,855 A 9/1998 Crisio, Jr.
5,827,064 A 10/1998 Bock
5,836,033 A 11/1998 Berge
5,875,510 A 3/1999 Lamond et al.
5,896,614 A 4/1999 Flewitt
5,898,967 A 5/1999 Wu et al.
5,908,038 A 6/1999 Bennett
5,921,251 A * 7/1999 Joshi ..... A46B 15/0002 132/112
5,943,723 A 8/1999 Hilfinger et al.
5,946,758 A 9/1999 Hohlbein et al.
5,946,759 A 9/1999 Cann
5,960,507 A 10/1999 Dutra et al.
5,966,769 A 10/1999 Tortorice
5,989,091 A 11/1999 Rodgers
6,006,394 A 12/1999 Bredall et al.
6,026,828 A 2/2000 Altshuler
6,029,303 A 2/2000 Dewan
6,029,304 A 2/2000 Hulke et al.
6,037,872 A 3/2000 Dunnum
6,065,176 A 5/2000 Watanabe et al.
6,074,076 A 6/2000 Parrish-Bhagwat
6,076,223 A 6/2000 Dair et al.
6,081,957 A 7/2000 Webb
6,084,504 A 7/2000 Rosche et al.
6,088,869 A 7/2000 Kaneda et al.
6,098,497 A 8/2000 Larose
6,106,294 A 8/2000 Daniel
6,108,851 A 8/2000 Bredall et al.
6,154,912 A 12/2000 Li
6,178,579 B1 1/2001 Blaustein et al.
6,178,582 B1 1/2001 Halm
6,189,693 B1 2/2001 Blaustein et al.
6,202,241 B1 3/2001 Hassell et al.
6,202,242 B1 3/2001 Salmon et al.
6,202,245 B1 3/2001 Khodadadi
6,299,770 B1 10/2001 Diener et al.
6,317,390 B1 11/2001 Cardoza
6,318,685 B1 11/2001 Huber
6,332,233 B1 12/2001 Proulx
6,338,176 B1 1/2002 Smith et al.
6,341,400 B1 1/2002 Kobayashi et al.
6,349,445 B1 2/2002 Mackay et al.
6,357,072 B1 3/2002 Zinn
6,360,395 B2 3/2002 Blaustein et al.
6,367,112 B1 4/2002 Moskovich et al.
6,389,633 B1 5/2002 Rosen
D458,454 S 6/2002 Nanda
D458,757 S 6/2002 Dunn et al.
D458,758 S 6/2002 Nanda
6,409,046 B1 6/2002 Peckels
6,437,267 B1 8/2002 Imai
6,536,068 B1 3/2003 Yang et al.
6,588,593 B2 7/2003 Woskoski
6,606,755 B1 8/2003 Robinson et al.
6,611,780 B2 8/2003 Lundell et al.
6,622,978 B1 9/2003 Ghiz
6,623,272 B2 9/2003 Clemans
D483,568 S 12/2003 Jamson
6,698,626 B2 3/2004 McKay
6,725,490 B2 4/2004 Blaustein et al.
D490,247 S 5/2004 Nanda
6,735,802 B1 5/2004 Lundell et al.
D492,116 S 6/2004 Nanda
6,752,627 B2 6/2004 Lin
6,763,977 B2 7/2004 McKay
6,883,353 B2 4/2005 Goldoni et al.
D505,015 S 5/2005 Nanda
6,895,625 B2 5/2005 Lev et al.
D508,399 S 8/2005 Nanda
6,944,903 B2 9/2005 Gavney, Jr.
6,954,961 B2 10/2005 Ferber et al.
7,013,522 B2 3/2006 Kumagai
7,017,408 B2 3/2006 Ramus et al.
7,080,980 B2 7/2006 Klupt
7,109,431 B2 9/2006 Yanai et al.

(56) References Cited

U.S. PATENT DOCUMENTS

| | | | | |
|---|---|---|---|---|
| 7,127,769 | B2 | 10/2006 | Chang et al. | |
| 7,168,122 | B1 | 1/2007 | Riddell | |
| 7,201,172 | B2 | 4/2007 | Nanda | |
| 7,219,486 | B1 | 5/2007 | Conforth | |
| 7,240,390 | B2 | 7/2007 | Pfenniger et al. | |
| 7,293,318 | B1 | 11/2007 | Kuo | |
| 7,293,458 | B2 | 11/2007 | Ramus et al. | |
| 7,418,757 | B2 | 9/2008 | Gatzemeyer et al. | |
| 7,478,960 | B2 | 1/2009 | Glover | |
| D587,905 | S | 3/2009 | Wong | |
| 7,515,507 | B2 | 4/2009 | Nanda | |
| 7,596,827 | B1 | 10/2009 | Puneet | |
| 7,599,506 | B2 | 10/2009 | Fib et al. | |
| 7,601,655 | B2 | 10/2009 | Katsin | |
| 7,713,461 | B2 | 5/2010 | Pfenniger et al. | |
| 7,718,906 | B2 | 5/2010 | Au et al. | |
| 7,748,072 | B2 | 7/2010 | Rycroft | |
| 7,793,379 | B2 | 9/2010 | Weiss | |
| 7,841,041 | B2 | 11/2010 | Moskovich et al. | |
| 7,845,039 | B2 | 12/2010 | Chan et al. | |
| 7,845,041 | B2 | 12/2010 | Gatzemeyer et al. | |
| 7,845,042 | B2 | 12/2010 | Moskovich | |
| 7,846,536 | B2 | 12/2010 | Dubey | |
| 7,882,588 | B2 | 2/2011 | Dragan et al. | |
| 7,901,115 | B2 | 3/2011 | Chien | |
| 7,910,795 | B2 | 3/2011 | Thomas et al. | |
| 8,006,342 | B2 | 8/2011 | Nanda | |
| 8,011,054 | B2 | 9/2011 | Nanda | |
| 8,075,315 | B2 | 12/2011 | Gatzemeyer et al. | |
| 8,079,109 | B2 | 12/2011 | Misner et al. | |
| 8,141,563 | B2 | 3/2012 | De Masi, Sr. | |
| 8,327,491 | B2 | 12/2012 | Nanda | |
| 8,413,286 | B2 | 4/2013 | Nanda | |
| 8,424,144 | B2 | 4/2013 | Nanda | |
| 8,484,793 | B2 | 7/2013 | Nanda | |
| 8,561,244 | B2 | 10/2013 | Nanda | |
| 8,707,500 | B2 | 4/2014 | Nanda | |
| 9,060,596 | B2 | 6/2015 | Nanda | |
| 9,084,473 | B2 | 7/2015 | Nanda | |
| D739,767 | S | 9/2015 | Schleining | |
| 9,694,603 | B1 | 7/2017 | Jariabka et al. | |
| 2002/0100134 | A1 | 8/2002 | Dunn et al. | |
| 2003/0104340 | A1* | 6/2003 | Clemans | A46B 15/0002 433/215 |
| 2003/0140437 | A1 | 7/2003 | Eliav et al. | |
| 2003/0205492 | A1 | 11/2003 | Ferber et al. | |
| 2003/0221267 | A1 | 12/2003 | Chan | |
| 2004/0057233 | A1 | 3/2004 | Sharrah et al. | |
| 2004/0143920 | A1 | 7/2004 | Nanda | |
| 2004/0168272 | A1 | 9/2004 | Prineppi | |
| 2005/0150067 | A1 | 7/2005 | Cobabe et al. | |
| 2006/0037158 | A1 | 2/2006 | Foley et al. | |
| 2006/0174331 | A1 | 8/2006 | Nanda | |
| 2006/0207043 | A1 | 9/2006 | Yamamoto | |
| 2007/0038272 | A1* | 2/2007 | Liu | A46B 15/0034 607/88 |
| 2007/0039109 | A1 | 2/2007 | Nanda | |
| 2007/0074359 | A1 | 4/2007 | O'Lynn | |
| 2007/0131241 | A1 | 6/2007 | Nanda | |
| 2007/0261185 | A1 | 11/2007 | Guney et al. | |
| 2007/0271760 | A1 | 11/2007 | Nanda | |
| 2008/0028553 | A1 | 2/2008 | Batthauer | |
| 2008/0222822 | A1* | 9/2008 | Cobabe | A46B 15/0036 15/28 |
| 2008/0250591 | A1 | 10/2008 | Nanda | |
| 2008/0256730 | A1 | 10/2008 | Chen | |
| 2008/0276398 | A1 | 11/2008 | Nanda | |
| 2009/0070947 | A1 | 3/2009 | Baertschi et al. | |
| 2009/0119861 | A1 | 5/2009 | Nanda | |
| 2009/0144919 | A1 | 6/2009 | Nanda | |
| 2009/0144920 | A1 | 6/2009 | Nanda | |
| 2010/0024143 | A1 | 2/2010 | Dickie | |
| 2010/0106336 | A1 | 4/2010 | Hwang et al. | |
| 2011/0232012 | A1 | 9/2011 | Nanda | |
| 2011/0232015 | A1 | 9/2011 | Nanda | |
| 2012/0110764 | A1 | 5/2012 | Nanda | |
| 2013/0139333 | A1 | 6/2013 | Nanda | |
| 2013/0239347 | A1 | 9/2013 | Nanda | |
| 2014/0230171 | A1 | 8/2014 | Nanda | |
| 2015/0013089 | A1 | 1/2015 | Nanda | |

FOREIGN PATENT DOCUMENTS

| | | |
|---|---|---|
| CN | ZL200430004025.6 | 11/2004 |
| CN | ZL200520056294.6 | 3/2005 |
| CN | 2751577 | 1/2006 |
| CN | ZL200420095907.2 | 1/2006 |
| CN | 2787464 | 6/2006 |
| CN | 2838386 | 11/2006 |
| CN | 2933128 | 8/2007 |
| CN | 201194632 | 2/2009 |
| CN | 201274863 | 7/2009 |
| DE | 4029770 | 3/1992 |
| DE | 19811676 | 9/1999 |
| DE | 40210646-0001 | 7/2003 |
| EM | 000050851-0001 | 7/2003 |
| FR | 2680086 | 2/1993 |
| FR | 2724297 | 3/1996 |
| FR | 2756471 | 6/1998 |
| GB | 3006965 | 9/2002 |
| GB | 2406503 | 3/2006 |
| JP | 55-90342 | 12/1978 |
| JP | 64-008914 | 1/1989 |
| JP | 01-203193 | 8/1989 |
| JP | 2004-222839 | 8/2004 |
| JP | 2006-042966 | 2/2006 |
| KR | 1020040004088 | 1/2004 |
| KR | 1020040052897 | 6/2004 |
| KR | 2020090008690 | 8/2009 |
| WO | 96/14025 | 5/1996 |
| WO | 00/20185 | 4/2000 |
| WO | 2005/046508 | 5/2005 |
| WO | 2008/128109 | 10/2008 |
| WO | 2009/062098 | 5/2009 |
| WO | 2012/033553 | 3/2012 |

OTHER PUBLICATIONS

International Search Report and Written Opinion for International Application No. PCT/US2008/082886; dated Jan. 23, 2009.
International Search Report and Written Opinion for International Application No. PCT/US11/038760; dated Feb. 24, 2012.
International Search Report and Written Opinion for International Application No. PCT/US2006/014951; dated Jul. 27, 2007.
Biotene, http://www.laclede.com/products/mouthwash.asp; archive date of Dec. 31, 2004 from Internet Archive Wayback Machine; 2 pages.
Act Dental Rinse, http://hocks.com.hocks_com_on_line_pharmacy/2546877.html; archive date of Nov. 12, 2004 from Internet Archive Wayback Machine; 2 pages.
Gum® Crayola™ Marker Toothbrush, http://www.gumbrand.com/kids/kids-crayola/gum-crayola-marker-toothbrush-227kka.html; printed Sep. 12, 2014; 2 pages.
Dimensions of Dental Hygiene, www.dimensionsofdentalhygiene.com, May 2007; 2 pages.
Signal Croissance Junior, http://signalplus.com.html.a34c.html, Oct. 18, 2012; 2 pages.
Sunstar Americas Catalog, 2007; 1 page.
Switch Users—Assistive Technology Training Online Project; http://atto.buffalo.edu/registered/ATBasics/Populations/Switch/printmodule.php; Oct. 11, 2013; 12 pages.
Photograph of Timer Toothbrush; 2004; 1 page.
Photograph of Timer Toothbrush; 2002; 1 page.
Photograph of Timer Toothbrush with suction bottom; 1 page.
Photograph of Timer Toothbrush; 1 page.

* cited by examiner

ILLUMINATED FLASHING TOOTHBRUSH AND METHOD OF USE

PRIORITY INFORMATION

This application is a continuation of application Ser. No. 16/141,550, filed Sep. 25, 2018, which is a continuation of application Ser. No. 14/804,255, filed Jul. 20, 2015, now U.S. Pat. No. 10,085,549, which is a continuation of application Ser. No. 14/505,280, filed Oct. 2, 2014, which is a continuation of application Ser. No. 14/263,567, filed Apr. 28, 2014, now U.S. Pat. No. 9,060,596, which is a continuation of application Ser. No. 13/890,183, filed May 8, 2013, now U.S. Pat. No. 8,707,500, which is a continuation of application Ser. No. 13/620,717, filed Sep. 15, 2012, now U.S. Pat. No. 8,561,244, which is a continuation of application Ser. No. 13/350,583, filed Jan. 13, 2012, now U.S. Pat. No. 8,327,491, which is a continuation of application Ser. No. 13/105,582, filed May 11, 2011, now U.S. Pat. No. 8,413,286, which is a continuation-in-part of application Ser. No. 11/734,732, filed Apr. 12, 2007, now U.S. Pat. No. 8,006,342. Application Ser. No. 13/105,582 also claims priority to provisional application No. 61/381,856, filed Sep. 10, 2010. The entirety of each of the above applications is herein incorporated by reference.

BACKGROUND OF THE INVENTION

Field of the Invention

The present inventions relate to dental hygiene and, more particularly, to toothbrushes.

Description of the Related Art

To ensure proper oral care, dentists recommend that we brush our teeth more than once a day for at least two to three minutes each time. Despite this recommendation, the average adult person does not brush his or her teeth for two to three minutes. This problem is worse with children, who have notoriously short attention spans and often view brushing their teeth as a chore. Accordingly, there is a general need for a device that encourages people, especially children, to brush their teeth more often and for longer periods of time. See e.g., U.S. Patent Publication No. 2004-0143920, filed Jan. 24, 2003 and published on Jul. 29, 2004, the entirety of which is hereby incorporated by reference herein.

SUMMARY OF THE INVENTION

U.S. Patent Publication No. 2004-0143920 describes a toothbrush with a handle having a base, a body, and a head. The body can have a first section and a second section forming an oblique angle. A projector of a beam of light is located within the handle. The toothbrush can have at least one bristle attached to the head. The toothbrush can have a grip attached to the base. An illumination circuit can be positioned within the handle and is operated by pressing an end of the handle. Pressing the end of the handle can compress a spring which completes the illumination circuit, activating the projector of a light beam within the toothbrush. Applicant has recognized that some children may have trouble activating the illumination circuit. Accordingly, a need exists for an improved activation mechanism, among other things.

According to some embodiments, a toothbrush can comprise a handle having a first end and a second end, a head coupled to the first end of the handle and an illumination element within the handle. The head can include a plurality of bristles. The toothbrush can further include a power source connected to the illumination element, an activation device and a timing circuit. The illumination element can be activated during all, part of, and/or at the end of, a set period of time.

In some embodiments, a toothbrush can comprise a handle, a light, a plurality of bristles, a power source, a switch mechanism, and a pliant base. The handle can be made of a first material and have a base and a head, with a cavity in the base. The light can be positioned in the cavity in the base. The switch mechanism can be configured to illuminate the light. The pliant base can comprise a second material different from the first material, the second material being flexible. The pliant base can have a first portion and a second portion, with the first portion attached to the base of the handle, the second portion extending therefrom and positioned around at least a portion of the switch mechanism such that the second portion is configured to move with respect to the first portion when a force is applied to the second portion which contacts the switch mechanism and illuminates the light. The switch mechanism can comprise a first member and a second member, with the second member positioned within the pliant base and configured to move with the second portion of pliant base. The second member can be positioned with respect to the first member such that the second member contacts the first member when the pliant base is moved inward towards the handle but does not contact the first member when the pliant base is in an unstressed condition. When the first member contacts the second member, the light is illuminated for a period of time.

In some embodiments, a toothbrush can include a handle having a first end and a second end, the handle defining a cavity that has a cavity opening from the second end and a head coupled to the first end of the handle, the head comprising a plurality of bristles. A light can be positioned in the cavity with a power source coupled to the light in fixed positional relationship within the cavity. A pliant base can be coupled to the second end of the handle, the pliant base surrounding at least a portion of the second end including the cavity opening and providing a water tight seal around the cavity opening. A first switch member and a second switch member can also be included where the second switch member can move with the pliant base such that the second switch member contacts the first switch member when pressure is applied to the pliant base but does not contact the first switch member when the pliant base is in an unstressed condition. A control circuit can be configured such that contact between the first contact member and the second contact member completes a circuit and initiates illumination of the light for a set period of time.

In some embodiments, a toothbrush includes a handle having a base and a head; a light positioned in the handle; a plurality of bristles attached to the head of the handle; and a power source fixedly connected to the light. A pliant base comprising a flexible material different from a material of the handle can have a first portion attached to the base of the handle and a second portion extending therefrom and movable with respect to the base of the handle, wherein the second portion of the pliant base is configured to move with respect to the first portion to activate the light. A switch mechanism can comprise an elongate rod that extends within the pliant base. The pliant base can surround the elongate rod such that manipulation of the pliant base causes a movement of part of the switch mechanism to activate the light, so that the light is illuminated for a period of time.

DETAILED DESCRIPTION OF THE PREFERRED EMBODIMENTS

Figure 1:
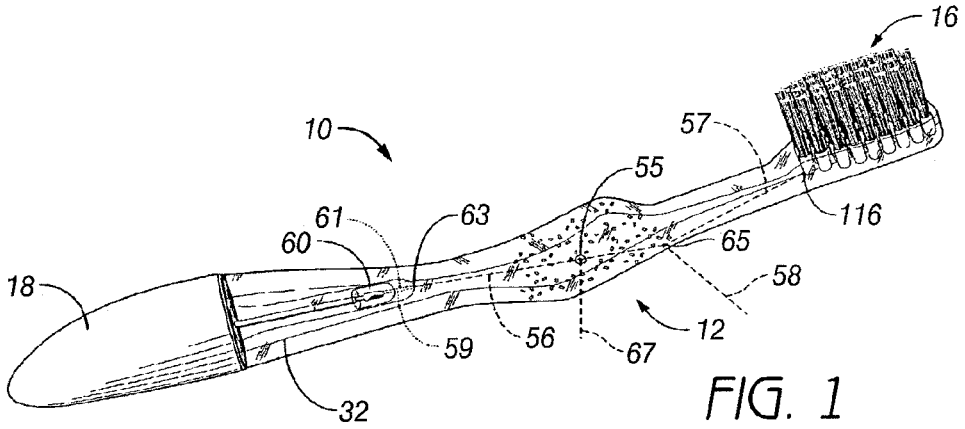
FIG. 1 (PRIOR ART)
FIG. 1 is a perspective view of a prior art toothbrush.
Figure 2:
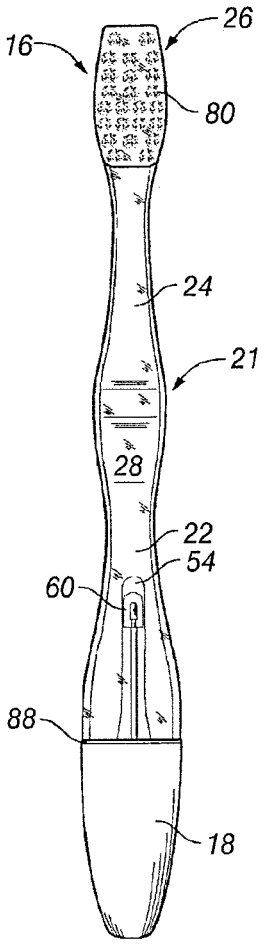
FIG. 2 (PRIOR ART)
FIG. 2 is a front elevation view of the toothbrush of FIG. 1 showing the brush side of the toothbrush.
Figure 3:
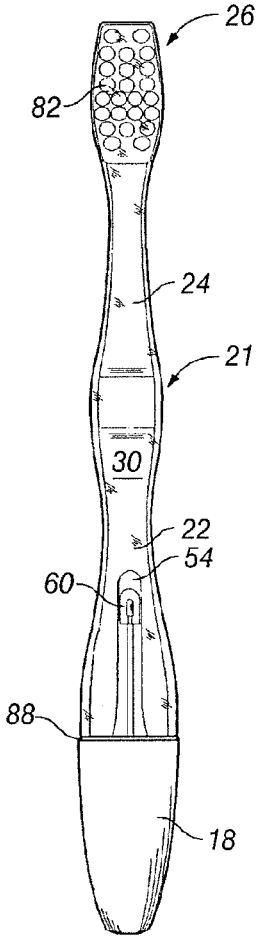
FIG. 3 (PRIOR ART)
FIG. 3 is a rear elevation view of the toothbrush of FIG. 1 showing the non-brush side of the toothbrush.

FIG. 1 illustrates a prior art illuminated toothbrush 10, which comprises a handle 12, an illumination circuit 14, a brush 16, and a grip 18.

As shown in FIG. 1, the handle 12 comprises a base 20, a body 21, and a head 26. The body 21 has a first section 22 and a second section 24. The handle 12 can be formed of hard, clear plastic. In one arrangement, the handle 12 can be a colored plastic. In another arrangement, the handle 12 can be a translucent plastic. In yet another embodiment, the handle 12 may be fashioned out of a plastic incorporating metallic flake 55.

The toothbrush handle 12 can be formed through an injection molding process. In such an embodiment, plastic in a liquid form can be injected into a mold having two sections. Liquid plastic can be injected into the mold where it is then allowed to solidify. When the mold is opened it creates a handle having a brush side 28 and a non-brush side 30. At the intersection of these two sides 28, 30 can be a ridge 32. The ridge 32 can be a surface characteristic resulting from the injection molding process. In the illustrated arrangement, the ridge 32 does not extend inside the handle 12 but exists on the surface. The injection molding process in constructing of the toothbrush handle 12 is conventional and does not form a part of the present invention.

Figure 5:
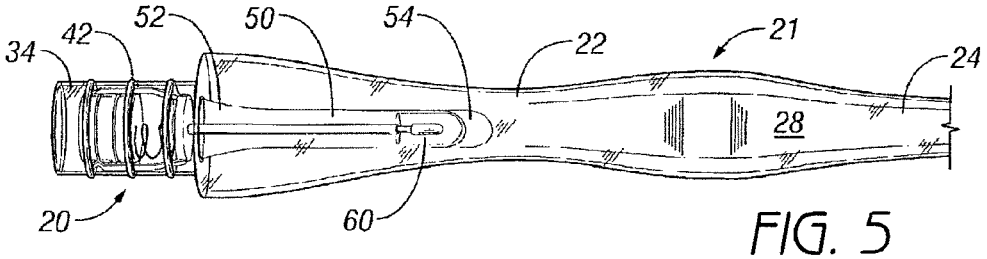
FIG. 5 (PRIOR ART)
FIG. 5 is a top view of the toothbrush with the grip removed exposing the toothbrush base and illumination circuit held within.
Figure 6:
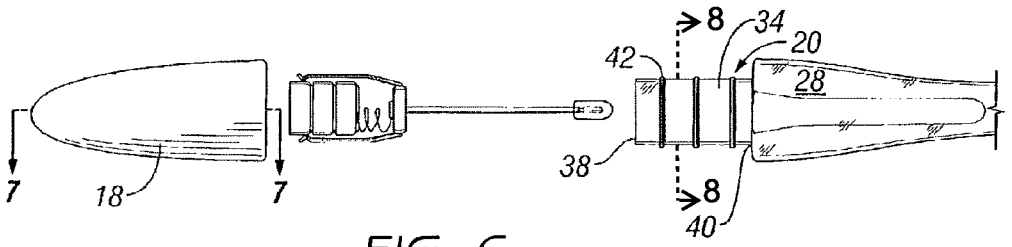
FIG. 6 (PRIOR ART)
FIG. 6 is an exploded top view of the toothbrush grip, base, and lower section of toothbrush handle showing the placement of the illumination circuit within the toothbrush handle.
Figure 8:
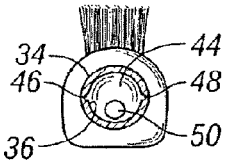
FIG. 8 (PRIOR ART)
FIG. 8 is a sectional view of the base in FIG. 6 showing the indentations for containing the positive terminal conductors.
Figure 9:
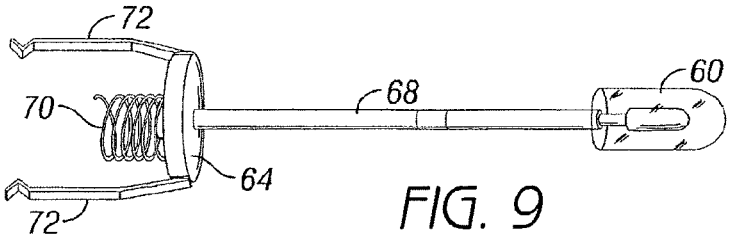
FIG. 9 (PRIOR ART)
FIG. 9 is a perspective view of the illumination circuit without the power supply.
Figure 10:
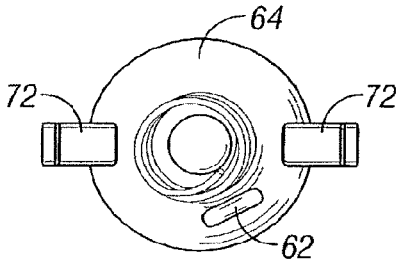
FIG. 10 (PRIOR ART)
FIG. 10 is a bottom view of the illumination circuit.
Figure 11:
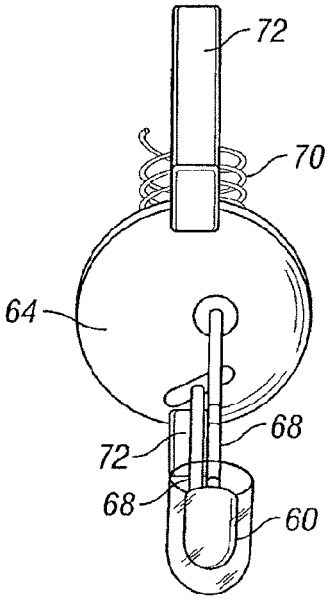
FIG. 11 (PRIOR ART)
FIG. 11 is a top perspective view of the illumination circuit.

As seen in FIGS. 5, 6, and 8, the handle 12 can include a handle base 20. The base 20 can be generally cylindrical in shape and can have a cavity 44 therein. The cavity 44 can have a centerline. The base 20 has an outside surface 34, an inside surface 36, a first end 38, and a second end 40. In the illustrated arrangement, on the outside surface 34 of the base 20 are three annular rings 42. The annular rings 42 can provide a ledge upon which the grip 18 holds.

The inside surface 36 defines the cavity 44. The inside surface 36 can have a first indentation 46 and a second indentation 48. The cavity 44 can serve as a housing for the illumination circuit 14. The first and second indentation 46, 48 can serve as a guide for positioning the illumination circuit 14 within the base 20.

A chamber 50 can extend within the section 22. The chamber 50 has a first end 52 and a second end 54. The chamber 50 can be generally cylindrical in shape. The first end 52 can be rounded and can provide a transition between the chamber 50 filled full of air and the first section 22 which is of plastic. The air is inherently present as a result of assembly at a time after the handle was formed. Alternatively, the chamber may be filled full of a material in a process separate from the forming of the handle.

The second end 54 of the chamber 50 can be open to the first end 38 of the base 20. The first section chamber 50 can be in off-center alignment with the base 20. As seen in FIG. 8, the first section chamber 50 is in off-center alignment with the base 20 to allow the projector of a light beam or illuminating member 60 to emit a light beam 56 that travels through the first section 22 and to strike the interface 65 between the second section 24 and atmosphere. At this interface, a light beam 57 can be reflected towards the handle head 26 and a light beam 58 can be refracted towards the atmosphere.

The first section chamber 50 can be also positioned in off-center alignment with the base 20 because in the first section 22 is ergometrically designed to accommodate a user's grip. In the ergometric design, the brush side 28 of the first section 22 is contoured and the non brush side 30 of the first section 22 is flat. In addition, the brush side 28 of the first section 22 arrives at a point of the second section 24 at a greater angle than the non brush side 30. In other words, the illumination circuit 14 extends within the first section 22 substantially parallel to the center line of the base member 20 but the first section 22 brush side 28 angles toward the inner point where the first section 22 meets the second section 24 and the non brush side 30 portion of the first section 22 also angles toward the point where the first section 22 meets the second section 24. Thus, for the first section chamber 50 to extend the furthest into the first section 22 of the handle 12, the first section chamber 50 is preferably positioned closer to the non-brush side 30 of the first section 22.

The illumination circuit 14 can have an illuminating member or projector of a light beam 60, a resistor 62, a timing circuit 64, and a power source 66. These parts can be joined by the conductor 68, which provides a support structure extending the illuminating member 60 a distance away from the timing circuit 64. The negative terminal conductor 70 can be a spring which presses against the power source 66, which in the illustrated arrangement comprises a series of batteries. The positive terminal conductor 72 can comprise a pair of prongs that extends away from the timing circuit 64 to embrace the power source 66. The positive terminal conductor 72 can also be sized to stabilize the illumination circuit 14 within the base 20 as the positive terminal conductor 72 is sized to fit within the first indentation 46 and the second indentation 48 of the base 20.

The illumination member 60 in this embodiment is a light emitting diode (LED). In other embodiments, the illumination member 60 could be an incandescent light bulb. In still other embodiments, the illumination member 60 may be any other device known in the art that may provide illumination.

The power source 66 in one arrangement can be microcell battery model number G3-ACNB. In the illustrated arrangement, three batteries are placed in series within the base 20. The timing circuit 64 preferably can function to illuminate the illumination member 60 for approximately 60 seconds. The timing circuit 64 also preferably can serve to control the illumination member 60 to blink intermittently for the time period in which it is engaged. In some embodiments, the illumination member 60 may stay on continuously and/or illuminate for a longer or shorter period of time. In the illustrated embodiment, the circuit is activated by closing an electrical switch 74 to complete a circuit.

The brush 16 can have a bristle 80. The bristle 80 can have a first end 82 and a second end 84. The bristle second end 84 can be embedded in the head 26 of the handle 12. In one arrangement, the bristle 80 can be made of clear plastic material. Moreover, in such an arrangement, the brush 10 can be configured such that, when the bristle 80 is struck by light traveling from the illumination member 60 through the first section 22 and the second section 24, a portion of the light striking the bristle 80 may reflect through the bristle 80 and extend out of the bristle 80.

Figure 4:
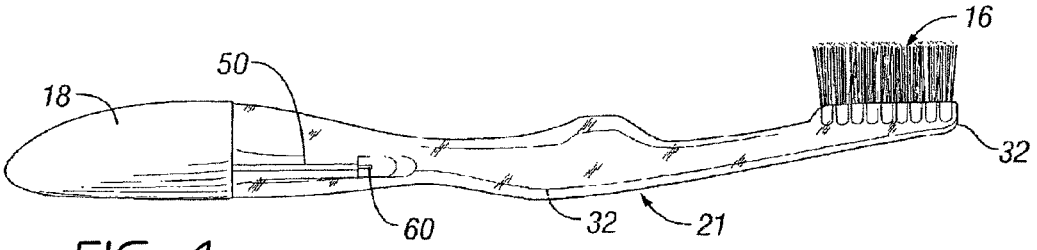
FIG. 4 (PRIOR ART)
FIG. 4 is a side view of the toothbrush of FIG. 1 showing the chamber preferentially placed near the non-brush side.
Figure 7:
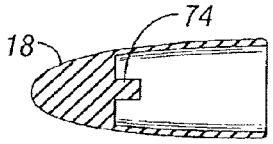
FIG. 7 (PRIOR ART)
FIG. 7 is a sectional view of the grip of FIG. 6.

The grip 18 can be made of a flexible material. In the illustrated arrangement, the grip 18 can also serve as a switch. For example, the grip 18 can have an extending piece or switch 74 of flexible material as seen in FIG. 7. When the grip is pushed in the direction of arrow A in FIG. 4, the piece 74 moves the positive terminal metal conductor 72 to contact the power source 66. Alternatively, the piece 74 moves the power source 66 to contact the positive terminal metal conductor 72. In doing so, the piece 74 moves illumination circuit 14 from an un-illuminated position to an illuminated position. The grip 18 can remain in place on the base 20 by engaging the annular rings 42 on the outside surface 34 of the base 20. An adhesive 88 can be positioned between the first section 22 and the grip 18 to hold the grip 18 in close connection with the first section 22.

The grip 18 can be made of a flexible material. Alternatively, the grip 18 may be of a hard material but have a flexible portion that may be used to engage the positive terminal conductor 72 and press against the power source 66.

In operation, the illuminated toothbrush 10 is used by a user to indicate the duration of an amount of time. The user grips the toothbrush handle 12 in their hand with the bristle 80 surface with the bristle 80 against their teeth and engages the illumination circuit switch 74. The illumination member 60 begins to blink intermittently in an on/off fashion. The illumination member 60 continues to blink for a period of approximately 60 seconds. The handle is designed to direct light to the user in multiple ways so that the user may be accurately apprised of brushing time. The frequency of blinking can remain constant, or vary in frequency. In some embodiments, the frequency can increase as the time approaches 60 seconds. In some embodiments, the frequency can remain constant through a first period of time, and increase in frequency in a second period of time. In one example, the frequency can remain constant for approximately 45 seconds; then increase for the remaining 15 seconds. In other embodiments, different time intervals can be used, such as, for example, two even periods of thirty seconds each.

A light beam 59 travels from the illuminating device 14 through a first section chamber 50. The light beam 59 strikes an interface 63 between the first section chamber and the first section and a light beam 61 is partially reflected off of the interface and a light beam 56 is refracted enters the first chamber. The light beam 56 travels through the first section 22 to strike upon an interface 65 between the second section 24 and atmosphere. A light beam 57 is reflected from interface 65 toward head 26 and a light beam 58 is refracted towards the atmosphere. The light beam 57 then strikes an interface 116 between the head 26 and bristle 80 where it is partially reflected and refracted.

Alternatively, the toothbrush handle may have a metallic piece 55 or flake embedded in the hardened plastic. The angle of reflection upon the flake is equal to the angle of incidence upon the flake. These metallic pieces 55 can be glitter. In operation, light will strike these metallic pieces 55 at an angle of incidence and the reflected light beam 67 directed at an angle of reflection as seen in FIG. 1.

One disadvantage of the arrangement described above is that the mechanism for completing the activation of the illumination is mechanically inefficient and often requires a degree of strength and dexterity not possessed by children.

Figure 13:
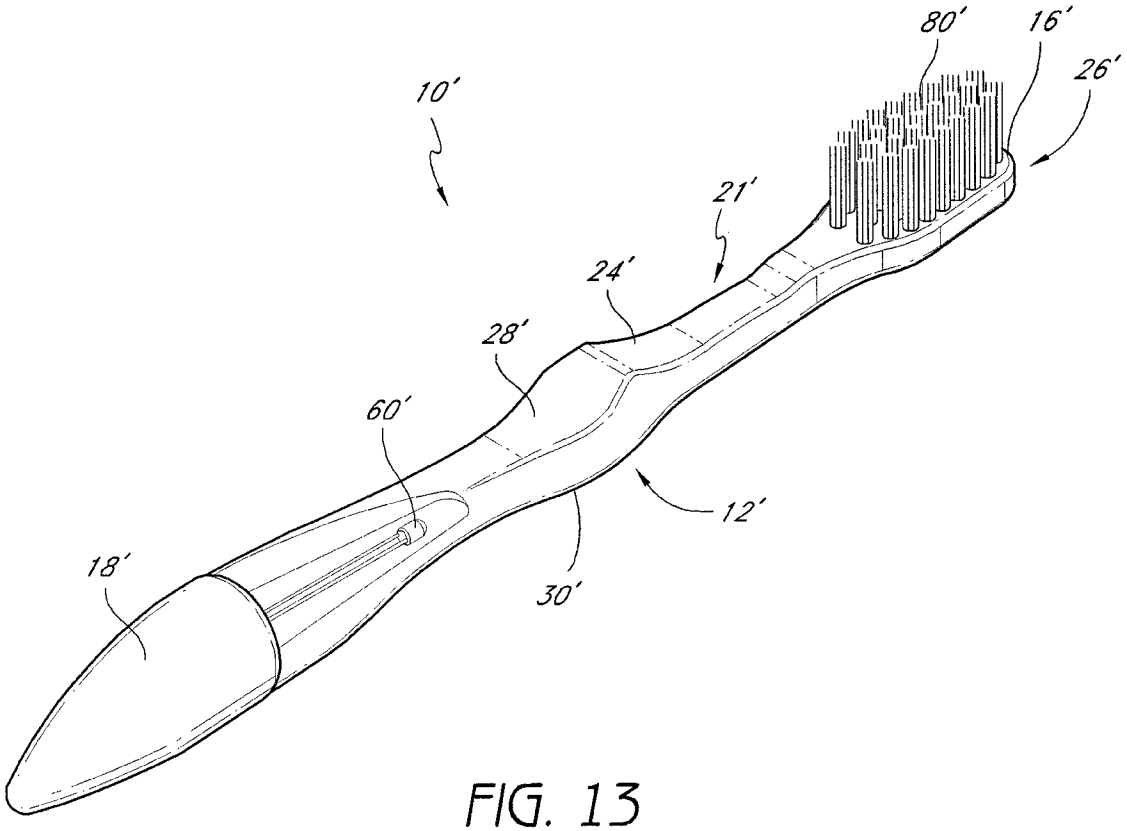
FIG. 13 is a brush side perspective view of a toothbrush having certain features and advantages according to the present invention.
Figure 14:
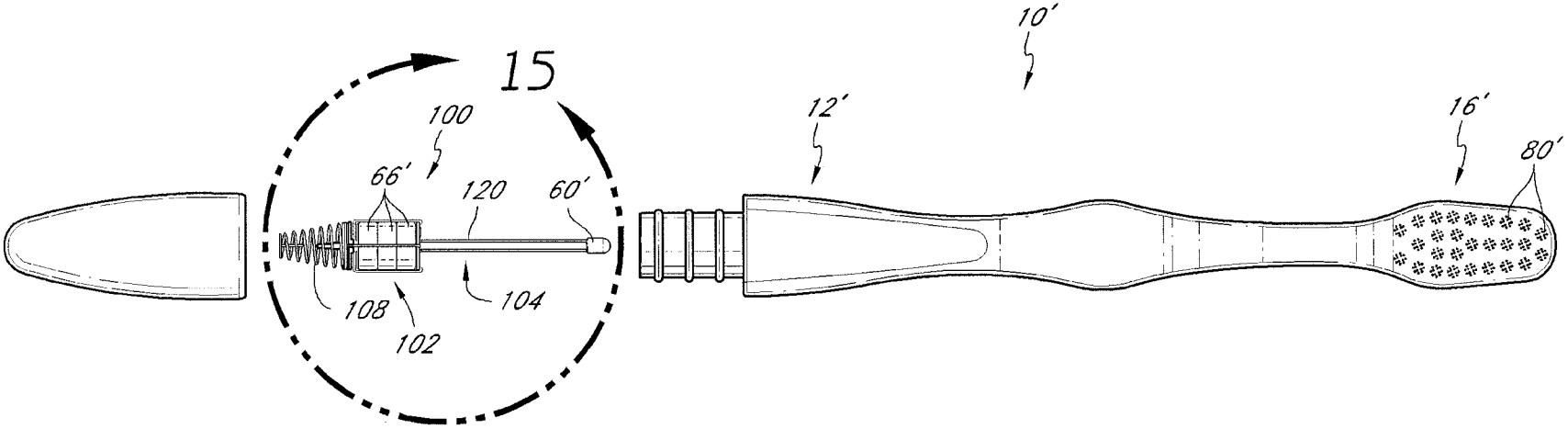
FIG. 14 is top brush side exploded view of the tooth brush of FIG. 13.
Figure 15:
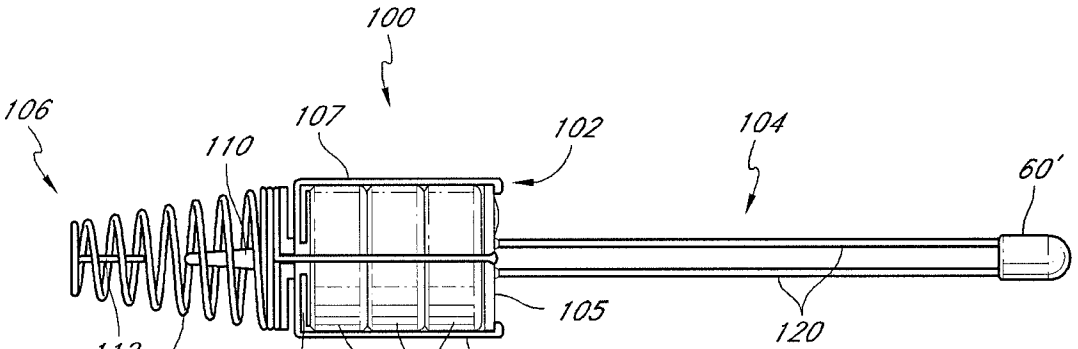
FIG. 15 is a closer view of section 15 of FIG. 14.

FIGS. 13, 14, and 15 illustrate a modified embodiment of a toothbrush that advantageously addresses the aforementioned problem. Numerical reference to components is the same as in the previously described arrangement, except that a prime symbol (') has been added to the reference. Where such references occur, it is to be understood that the components are the same or substantially similar to previously described components.

As can be seen the toothbrush can have an improved light generation mechanism 100. The mechanism 100 can be disposed in the base 18', as described above. In the illustrated embodiment, the mechanism 100 comprises a power portion 102, an extension portion 104, and an activation portion 106. The illuminating member 60' can be disposed at one end of one or more extension members 120, which can form the extension portion and can extend toward the base 18' and couple with the power segment 102.

The power segment 102 can comprise one or more power sources (e.g., batteries) 66'. The power sources 66' can be positioned between a distal member 105 and a proximal member 109, which in one embodiment can each comprise a circular disk-like plate. The power sources 66' can be secured in the space between the distal and proximal members 105, 109 and can be engaged by one or more generally rigid elongate members 107. The elongate members 107 can extend along the longitudinal axis of the toothbrush 10'. For additional security, the power sources 66' can be surrounded by a cylindrical member (not shown) that can be made of plastic or other similar material. In this manner, the power sources 66' cannot be easily dislodged from the power segment and swallowed by children if the base 18' is removed.

The power sources 66' can be in direct contact with each other or have an intervening electrical connection member (not shown). The power segment 102 can be coupled to an activation segment 106. The activation segment 106 can have a spring member 108. The spring member 108 can be a conical, as in the illustrated embodiment, or cylindrical, or any other shape appropriate for the interior or the base 18'. The spring member 108 can be composed of metal, though other materials can be used in other embodiments. Advantageously, an electrically-conducting material can be used. The spring member 108 can have an inward-extending protrusion 112 at one end. The protrusion 112 can be of any size or shape sufficient to extend towards the power sources 66' without contacting them. The protrusion 112 can be composed of the same material as the spring member 108, or can be composed of a different material, preferably an electrically-conductive material. In certain embodiments, the spring member 108 can be composed of a plastic and the protrusion 112 can be a metal. The spring member 108 can have an insulating or conducting coating.

The power segment 102 can have a contact member 110 extending toward the protrusion 112. The contact member 110 can be electrically-connected to the power sources 66' and the illumination circuit 14'. The contact member 110 can be connected such that contact with the protrusion 112 activates the illumination circuit 14'. Additionally, when electrically-conducting materials are used for the spring member 108, such as the metal in the illustrated embodiment, contact between the sides of the flexible member 108 and the contact member 110 can also activate the illumination circuit 14'.

Thus, although the illustrated embodiment is shown in FIGS. 14 and 15 in an exploded view, when the toothbrush 10' is assembled as in FIG. 13, manipulation of the pliable base 18' can cause deflection of the spring member 108 within. If the bottom of the base 18' is pushed toward the power segment 102, the protrusion 112 can touch the contact member 110, causing illumination. Alternatively, if the base 18' is deflected towards either side, the interior of the spring member 108 can touch the contact member 110, also causing illumination. The illumination can be continuous or intermittent. Additionally, the intervals between illuminations during intermittent operation can be regular or have increasing or decreasing frequency.

Figure 16:
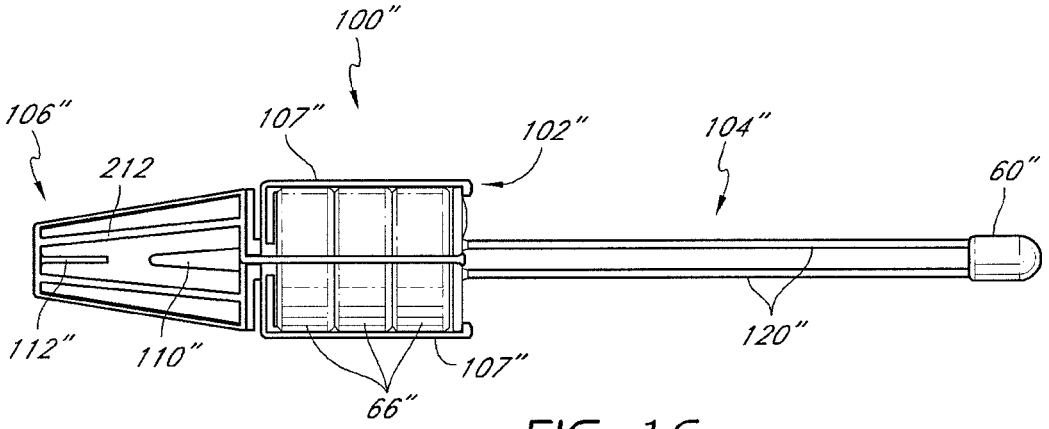
FIG. 16 is another embodiment of an illumination circuit.

FIG. 16 illustrates another embodiment of an illumination circuit. Numerical reference to components is the same as in previously described arrangements, except that a double prime symbol (") has been added to the reference. Where such references occur, it is to be understood that the components are the same or substantially similar to previously-described components.

Figure 12:
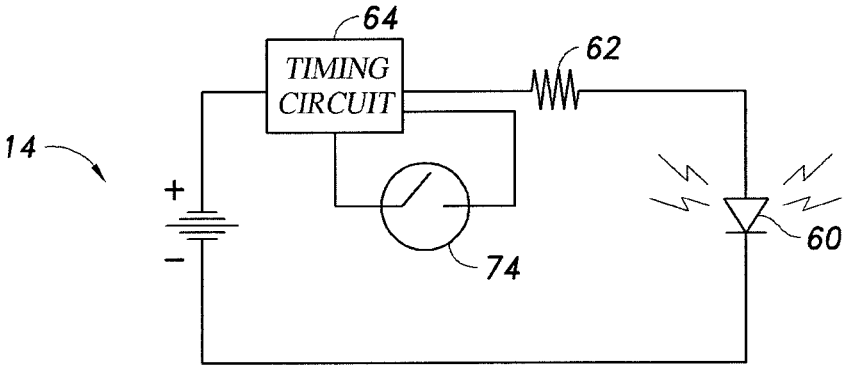
FIG. 12 is a schematic drawing of the illumination circuit.

As in other embodiments, a contact member 110" can be attached to a power segment 102". The contact member 110" can activate a circuit 14", as illustrated in FIG. 12. The embodiment of a mechanism 100" depicted in FIG. 16 has a plurality of flexible members 212 which enclose the contact member 110". The flexible members 212 can be composed of metal, an elastomer, or any of a variety of other materials which permit flexibility and have, or can support, an electrically-conductive surface. An inward-extending protrusion 112" can be integrally formed with the flexible members 212.

Unlike the cone-shaped spring member depicted in the embodiment illustrated in FIG. 15, the flexible members 212 can extend along a longitudinal axis of the mechanism 100". In some embodiments, the flexible members 212 taper inwardly as they extend away from the contact member 110". In other embodiments, the flexible members 212 do not taper, and maintain an approximately cylindrical shape. In yet other embodiments, the flexible members 212 can have other arrangements, including without limitation, a pyramidal prism, a rectangular prism, a cubic shape, or other geometrical shapes sized appropriately to surround the contact member 110".

Figure 17:
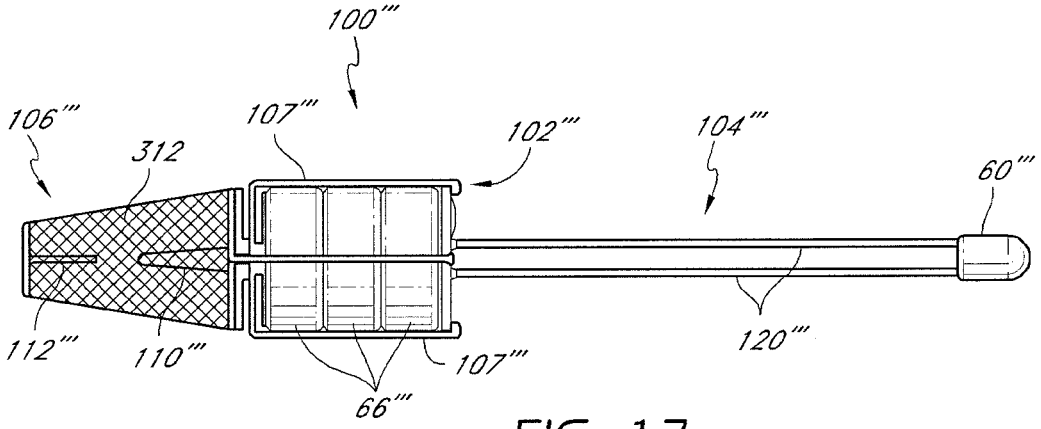
FIG. 17 is another embodiment of an illumination circuit.

FIG. 17 illustrates another embodiment of an illumination circuit 100'''. Numerical reference to components is the same as in previously described arrangements, except that a triple prime symbol (''') has been added to the reference. Where such references occur, it is to be understood that the components are the same or substantially similar to previously-described components.

The contact member 110''' can be enclosed within a flexible mesh, such as a metal wire mesh 312. The mesh 312 can have an interior contact surface which activates the illumination circuit 100''', or can structurally support such a surface. The wire mesh 312 can have an inward-extending protrusion 112''', as illustrated. In some embodiments, more than one protrusion is present on the interior of the component disposed around the contact member 110'''. These embodiments can include the use of spring members, flexible rods, flexible meshes, or any other contact surface or surface support configured to activate the illumination circuit.

Figure 18:
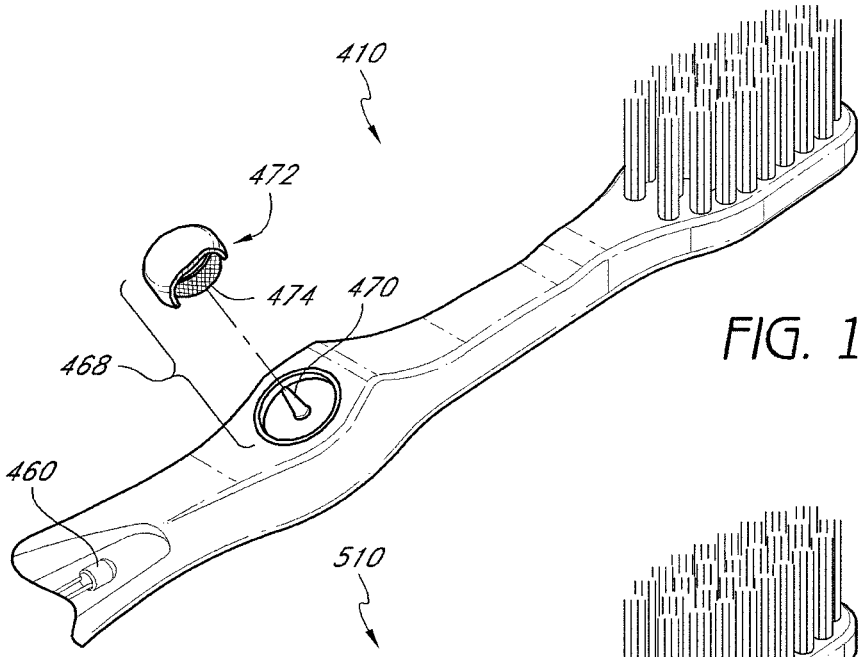
FIG. 18 is a perspective view of an embodiment of a toothbrush with a front-mounted button.
Figure 19:
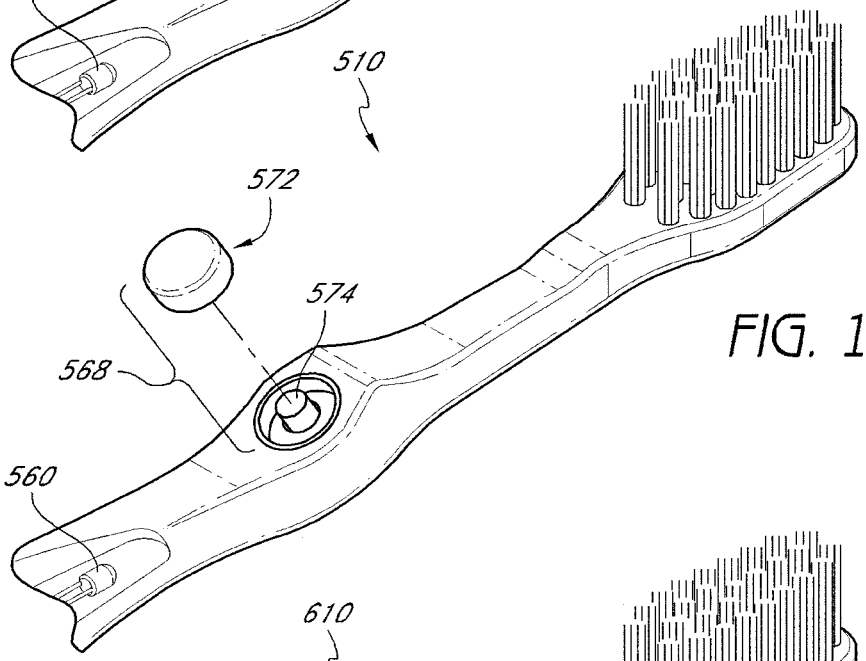
FIG. 19 is a perspective view of another embodiment of a toothbrush with a front-mounted button.
Figure 20:
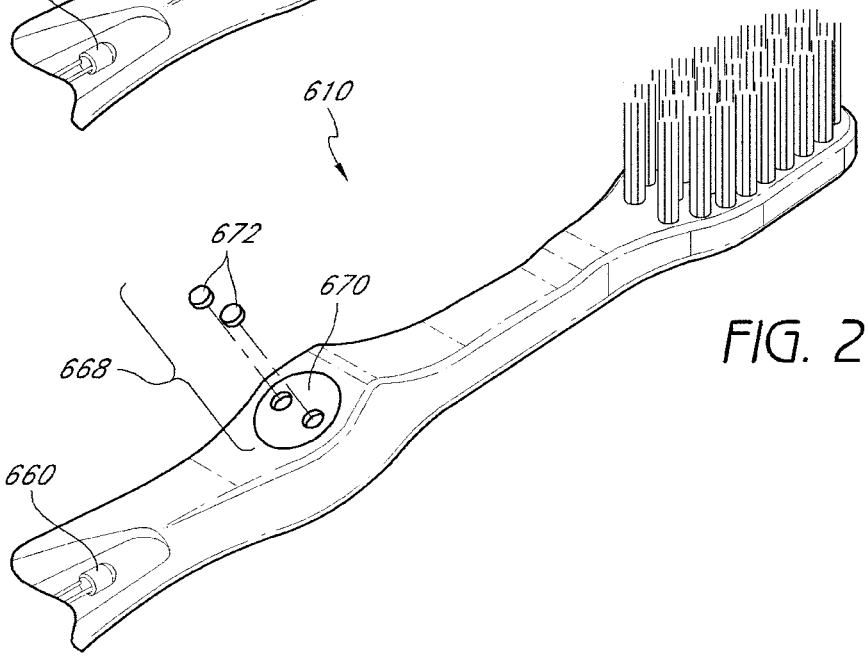
FIG. 20 is a perspective view of another embodiment of a toothbrush with a front-mounted button.
Figure 21A:
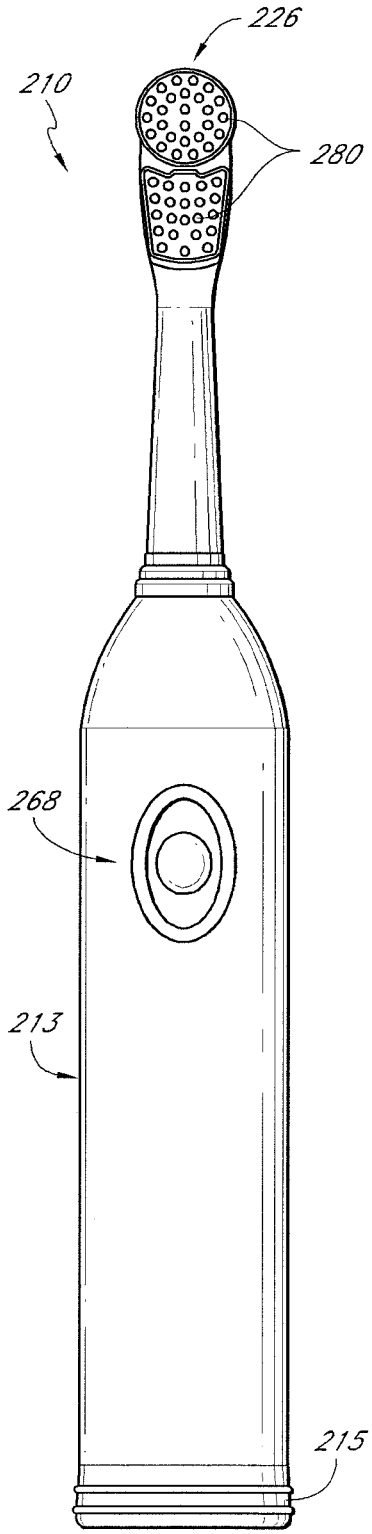
FIG. 21A-C is an embodiment of an electric toothbrush.
Figure 21B:
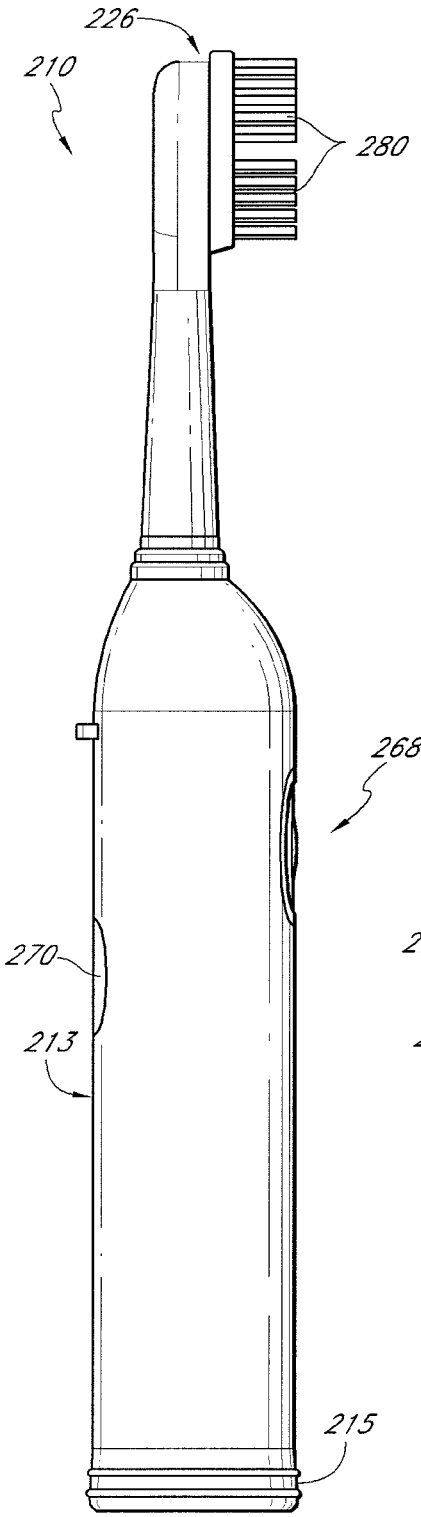
Figure 21C:
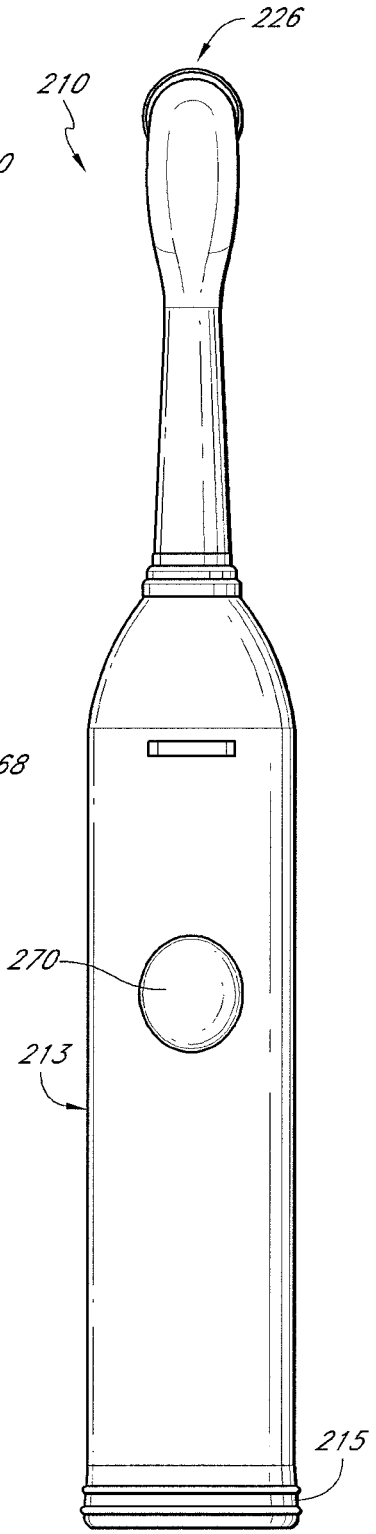

FIGS. 18-20 illustrate alternative embodiments of the toothbrush having a front-mounted activation mechanism for activating an illumination circuit 14. The mechanism can comprise a variety of devices, some examples of which are illustrated and described below.

FIG. 18 illustrates an embodiment of a toothbrush 410 having an illumination member 460 and an activation mechanism 468. The mechanism 468 can comprise a contact port 470 and a button 472. The button 472 can comprise a metallic mesh 474 that surrounds the contact post 470, and activates an illumination circuit 14, lighting the illumination member 460, as described above. The mesh 474 can case the illumination circuit 14 to activate through contact with an electrically-conducting inner surface, or support an electrically-conducting surface which activates the circuit 14. The mesh 474 can be replaced by a spring, flexible rods, or any other suitable device, as described above.

FIG. 19 illustrates another embodiment of a toothbrush 510 having a front-mounted activation mechanism. The mechanism can comprise a push-button device 568 having a button 572 and a switch device 574, as are well-known in the art. The push-button device 568 can cause the illumination member 560 to blink by activating an illumination circuit 14. The switch device 574 can be activated by manipulation of the button 572, whether the button 572 is flexible or a rigid connection to the switch device 574. The pushbutton device 568 can activate the circuit 14 once manipulated, and future manipulations can be ignored by the circuit 14 until the timer has completed a cycle. This operation can occur in any embodiment described herein.

FIG. 20 illustrates another embodiment of a toothbrush 610, wherein an illumination member 660 is set to blink by an illumination circuit 14. The circuit 14 can start a timed cycle upon receiving a signal from an activation device 668. In the illustrated embodiment, the activation device 668 comprises a base 670 and two contact terminals 672. The contact terminals 672 can activate the circuit 14 when electrical conduction occurs between the terminals 672. In one embodiment, the circuit 14 and terminals 672 can be constructed to allow contact with human skin to both terminals 672 to cause conduction to occur, thereby activating the circuit 14. In non-limiting examples, the palm of a human hand gripping the toothbrush can activate the circuit or, a finger or thumb pressed to touch both terminals 672 can activate the circuit 14. Water disposed in continuous contact with both terminals 672 can also activate the circuit 14.

FIGS. 21A-22B illustrate an embodiment of an electric toothbrush 210. The toothbrush 200 can include a motor 220 configured to impart motion to at least part of the bristles 280. For example at least part of the bristles 280 can oscillate, rotate, and/or vibrate. Different sections of the bristles 280 may move differently from another section and may include a stationary section.

As shown, the electric toothbrush 210 has a head 226, and a handle 213. Bristles 280 are connected to the head 226. The electric toothbrush 210 is also shown with an activation mechanism 268 and a window 270. The activation mechanism 268 can be used to turn the motor 220 on and off. The activation mechanism 268 can also be used to start a timing circuit. Though a particular activation mechanism 268 is shown, an electric toothbrush can use any of a number of different activation mechanisms portions including those described elsewhere herein.

The window 270 can be made from translucent material, such that light from an illumination member 260 can be seen through the window 270. The window 270 can define a particular shape in the toothbrush, such as the illustrated oval window 270 within the handle 213 or a section of the toothbrush, such as a neck portion between the handle and the head or a top of the handle. The illumination member 260 can be a light bulb, an LED, an array of LEDs, or any other source of light, such as has been discussed previously. The illumination member 260 can be a single color or can be multicolored.

Figure 22A:
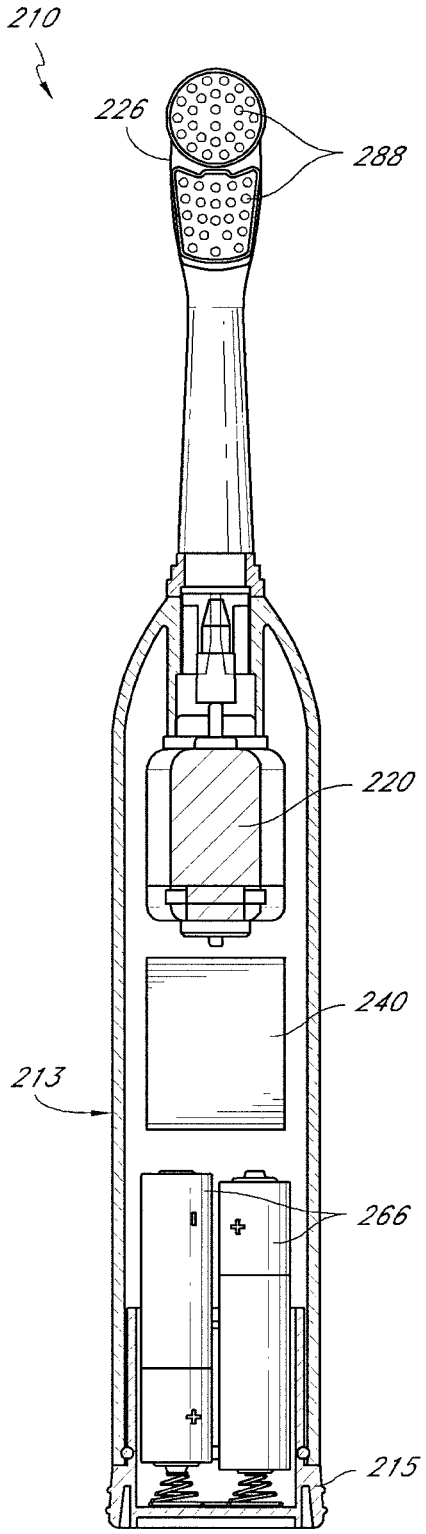
FIG. 22A is front view of the electric toothbrush of FIGS. 21A-C with the toothbrush partially disassembled and partially in cross-section.
Figure 22B:
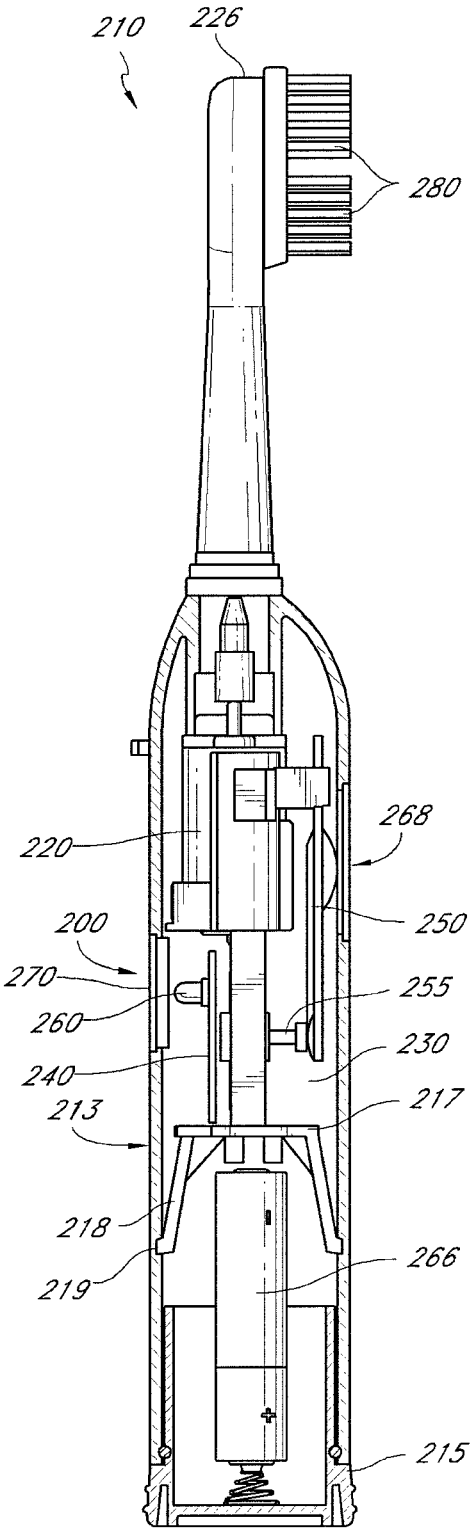
FIG. 22B is side view of the electric toothbrush of FIGS. 21A-C with the toothbrush partially in cross-section.

Referring now to FIGS. 22A-B, an internal chamber 230 can be seen within the electric toothbrush 210. The internal chamber 230 can serve as a housing for the various components of the electric toothbrush 210. The components can be completely or partially within the chamber 230. These components can include a motor 220, one or more power sources or batteries 266 and an activation mechanism 268. A cap 215 can used to gain access into the internal chamber 230. A frame 217 can be used to secure one or more of the components in place within the chamber 230.

In addition to driving a motor, the electric toothbrush 210 can include an illumination circuit 200 similar to those previously described. The illumination circuit can be connected to or can be separate from a motor drive circuit. In some embodiments, the motor drive circuit can be controlled by the activation mechanism 268. For example, pressing the activation mechanism 268 can close the circuit, turning the motor on and pressing the activation mechanism 268 a second time can open the circuit, turning the motor off. In some embodiments, the motor drive circuit can include a timer such that the motor is turned on for a limited duration, or the motor speed can change after a certain duration. For example, the duration can be determined by the timer. The duration can be 15 seconds, 30 seconds, 45 seconds, 60 seconds, 1.5 minutes, 2 minutes, etc.

As shown, the electric toothbrush 210 can include a printed circuit board (PCB) 240. The PCB 240 can be used in forming various electrical connections and circuits within the electric toothbrush 210. For example, the illumination member 260, motor 220, power source 266, activation mechanism 268 and other components of the illumination circuit 200 and/or the motor drive circuit can be connected to the PCB 240.

A frame 217 can be used to secure one or more of the components in place within the chamber 230. As shown, the frame 217 can be configured to surround a portion of the motor 220, while also securing the PCB 240 and the activation mechanism 268. In some embodiments, the frame 217 can include one or more legs or prongs 218. The prongs 218 can be used to engage the side wall of the internal chamber and secure the frame in place within the chamber. For example, the frame can be used to assemble at least some of the electrical components and/or internal components of the electric toothbrush 210 while outside of the toothbrush. The frame can then be inserted into the toothbrush. This can provide an efficient method of assembling an electric toothbrush. In some embodiments, the prongs 218 can engage a slot or hole 219 in the side wall of the internal chamber 230.

In some embodiments, the prongs 218 can also be used to position the power sources or batteries 266 within the internal chamber 230. For example, the prongs can be contoured to prevent a battery from moving from one side to another within the internal chamber 230.

In the illustrated embodiment of FIG. 22B, the activation mechanism 268 includes a lever 250 and a button 255. Depressing the lever 250 will also depress the button 255. The button 255 is connected to the PCB 240 and can activate the various circuits.

In some embodiments, the motor 220 can be turned on and off by the activation mechanism 268, while the illumination member 260 can be turned on by the activation mechanism 268 but thereafter controlled by the timer. For example, the illumination member 260 can remain illuminated for a certain duration, flash for a certain period of time, or illuminate after a certain period of time. The action of the illumination member can also change during a set duration. In some embodiments, the illumination member 260 can indicate to a user when a certain recommended time period for brushing teeth has passed and the user can then turn off the motor.

In some embodiments, both the illumination member 260 and the motor 220 can be connected to the timer. In this way, the functioning of the illumination member 260 and the motor 220 can coordinated. For example, the motor can be on for set period of time controlled by the timer and the illumination element can be used to indicate that and/or other time periods to a user. These time periods can include, among other things: the half way point, and/or when 60, 50, 45, 40, 30, 25, 20, 15, 10, and/or 5 seconds remain and/or when the time is up.

The activation mechanism 268 can also be used to turn off the illumination member 260 and/or the motor 210, whether or not a certain time period established by the timer has been completed.

The illumination member 260 can be located in many different positions within the electric toothbrush 210. In some embodiments, the illumination member 260 will be positioned next to or near the window 270, while in some embodiments, the illumination member will not be close to the window 270, yet light from the illumination member 260 will still be visible through the window 270.

Preferably, the window 270 will be located on the side of the toothbrush 210 opposite the bristles 280 or otherwise in a manner so that a user can see the window 270, illumination member 260 and/or light from the illumination member 260 in a mirror positioned in front of the user, such as a wall hanging bathroom mirror, while the user is brushing his or her teeth. In this way the illumination member 260 can readily be used to provide information to a user concerning a time period for brushing teeth. The use of a precisely placed window 270 also allows the other internal workings of the electric toothbrush 210 to remain hidden. Another benefit of having the window 270 on the back side of the handle 213, as shown, is that it avoids shining the light directly into the user's eyes.

In some embodiments, the window 270 can be frosted over, include a graphic, and/or otherwise prevent someone from viewing the internal components of the electric toothbrush 210 while still allowing light to pass through the window. In some embodiments, the window 270 can have embossing, or inscriptions.

The window 270, in some embodiments, can be a lithophane-like window. A lithophane generally refers to an etched or molded artwork in thin translucent porcelain that can only be seen clearly when back lit with a light source. A lithophane can present a three dimensional image that can change characteristics depending on the light source behind it.

In some embodiments, the window can be made of plastic of varying thickness. When light is shined through the window, the varying thicknesses of plastic can present an image because not all of the light will shine through the plastic to the same degree. Thus, thicker regions will be darker than thinner regions. The window can also be made from other materials besides plastic. Depending on the design, the image may be partially or completely visible without a direct source of light shining through the window.

The lithophane-like window 270 can also be made in ways other than that described above. For example, the window can have a varying thickness and/or can be imprinted with ink or other coatings such that the image is seen clearly when light shines through the window. Ink or other coatings can be used to create a similar affect to the varying thickness of material. Likewise, different materials can be joined together or used to create a lithophane-like affect. Certain methods of manufacture for a lithophane-like article are discussed in International Patent Cooperation Treaty Ap. No. PCT/GB99/01936 published as WO 00/20185, incorporated by reference herein.

The lithophane-like window 270 can present an image such as a cartoon character, a symbol, a brand name, or other feature that can be seen while the electric toothbrush is activated and the light is on. In some embodiments, the window 270 can include a combination of various aspects including lithophane-like, embossing, inscriptions, printing, etc.

The window 270 can be various shapes and sizes and can be placed in various positions along the handle 213. For example, the window 270 can be sized and shaped to be viewed from multiple directions or all directions. As another example, the window 270 can wrap around the handle to allow viewing from all directions. For example, FIGS. 21B, C and 22B show the window 270 at the back of the handle 213 and close to midway between the top and bottom of the handle yet closer to the top in the illustrated embodiment. In one embodiment, the window 270 is positioned on the handle 213 generally opposite the activation mechanism 268 with a portion the window 270 and the activation mechanism 268 being positioned generally above a gripping portion of the handle 213. In one embodiment, the gripping portion is defined by gripping aids (e.g., dimples, grooves, and/or softer or more pliable material added or formed onto the handle 213). In another embodiment, the window 270 is positioned above the top 10% of the gripping portion and/or gripping aids and in another embodiment above the top 25% of the gripping portion and/or gripping aids.

Figure 23:
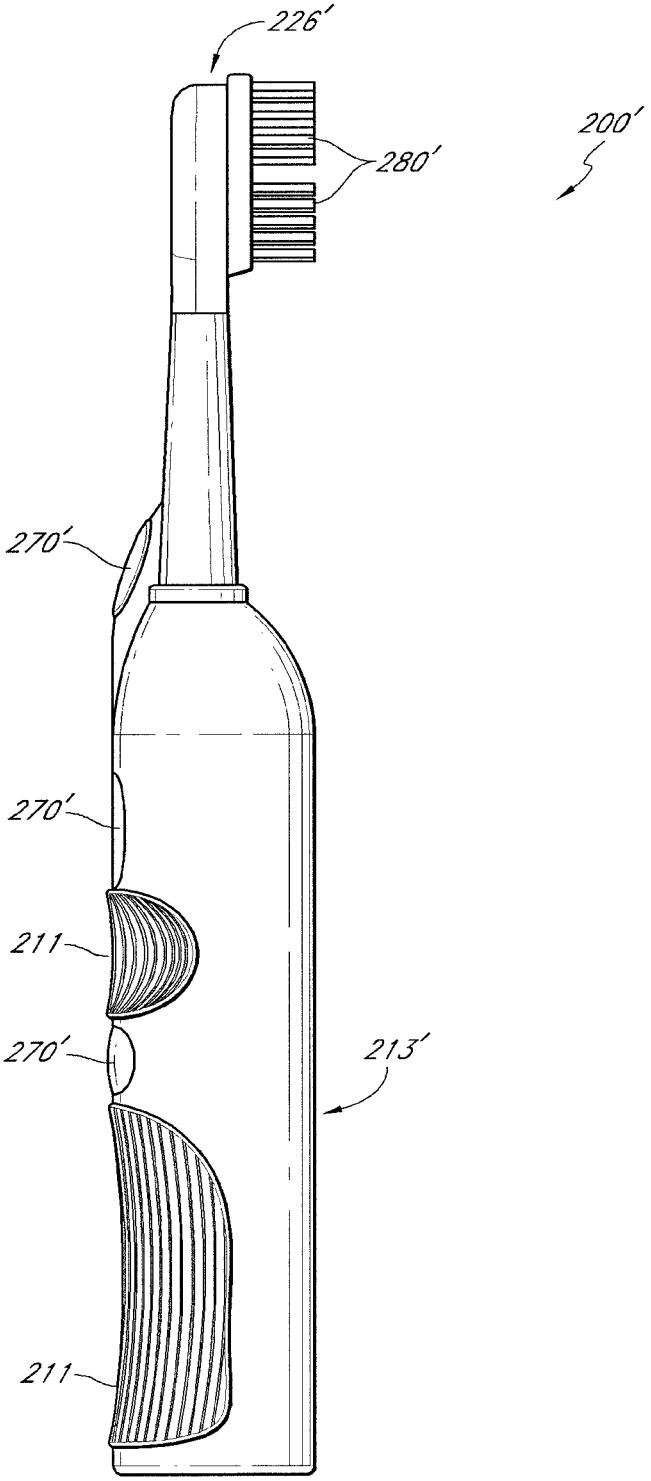
FIG. 23 shows another embodiment of an electric toothbrush.

In some embodiments, the window 270 and the handle 213 can be configured such that light from the illumination member 260 can be seen through a user's hand or fingers, in-between the users fingers, or above or below the fingers and hand. In some embodiments, the handle 213 can be configured such that gripping the handle at a grip section 211 opens the fingers to allow light to pass through the space between the fingers. Many of these embodiments and configurations can also be seen in the electric toothbrushes 200', 200" of FIGS. 23 and 24. For example, in FIG. 23, in one embodiment, the window 270' is located between two gripping portions 211 such that light will be passed between the portions of the hand gripping the brush 200'. In another embodiment, the widow 270' is located above the gripping portions 211 (see FIG. 23). In yet another embodiment, the window 270' can be located above the handle 213. In other embodiments, the window can be positioned in more than one of the locations described above.

Another factor in the location of the window 270 is the placement of the components within the internal chamber 230. Depending on such considerations as motor size, battery size or number of batteries, the space within the internal chamber 230 can limited. Thus, in some embodiments, the illumination element 260 and the PCB 240 can be located between the motor and the power source, as in FIG. 21-22, though other embodiments may require a more compact configuration.

Figure 24:
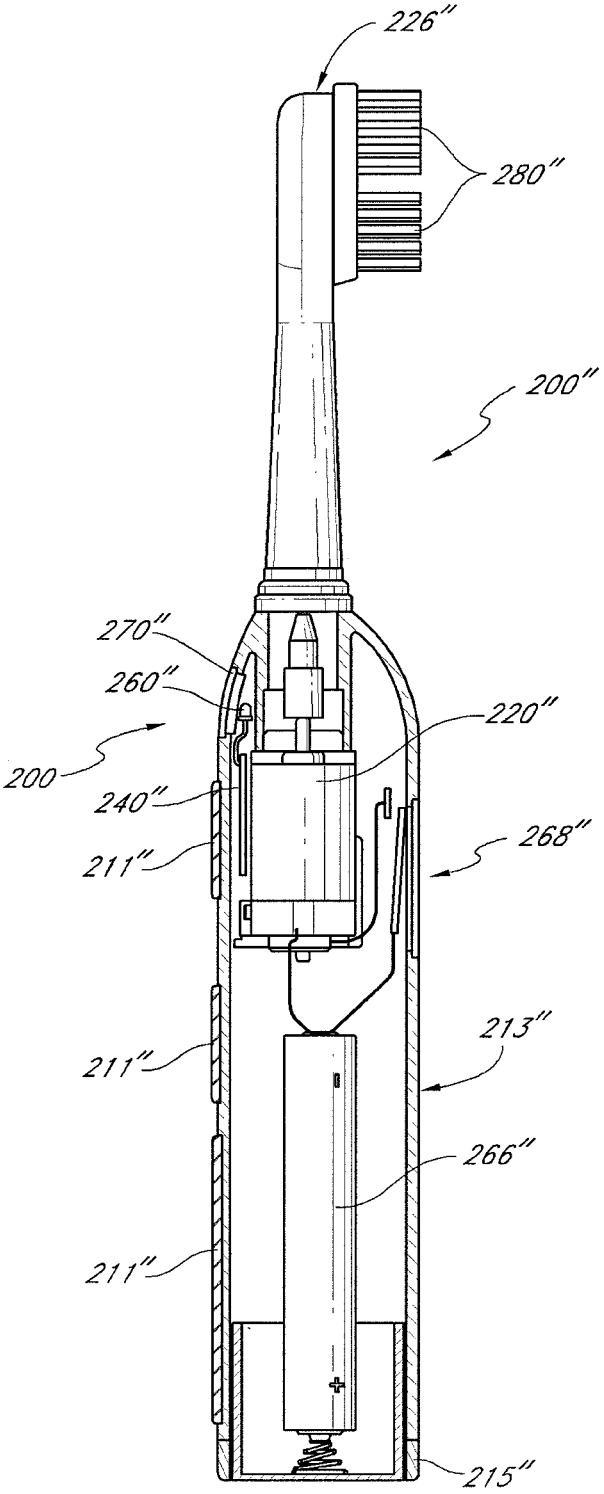
FIG. 24 illustrates a schematic embodiment of an electric toothbrush, with the toothbrush partially disassembled and partially in cross-section.

FIG. 24 illustrates another embodiment of an electric toothbrush 200". Here, the window 270" is located near the top of the handle 213". A user using the toothbrush 200" would be able to grip the toothbrush along the handle 213" such as at the gripping area 211" and see the illumination element in a mirror while the user is brushing his or her teeth.

As shown, the illumination element 260" and the PCB 240" are located between the motor and the window 270". In some embodiments, the PCB 240" and/or illumination element 260" can be connected to the motor 220".

In some embodiments, the electric toothbrush can include a display having a clock, stop watch, countdown timer and/or other type of digital or analog numeric timer. The display can used in conjunction with or instead of the timing circuits described herein. The display can also be backlit or otherwise illuminated. The illumination element can provide the backlighting of the display. The display can be an electronic or mechanical display.

In some embodiments, the illumination element can create a display by projecting information onto or through the window. The projected information can comprise various different types of information including time, time transpired, a countdown, battery life, brush life, etc. In one example, the illumination element can display, illuminate or project the number of seconds left to brush. The number can be illuminated through the window to show 60, 59, 58, 57, etc. as a countdown as to how many seconds are left to brush. In some embodiments, the numbers can be projected backwards so that they can be read while looking at a mirror.

In some embodiments, the toothbrush can be configured to relate the charge of the power sources or batteries 266 with the useful life of the bristles. For example, the charge of the batteries 266 can be set for a specified time period that has been determined under typical use conditions. When the batteries 266 run out this can indicate to a user that it is also time to replace the entire brush, for a disposable brush, or the bristles/head for a nondisposable brush. In addition, an indicator, such as in the window, or in the display, can indicate to the user to change the batteries and/or the bristles or the entire brush.

Although certain embodiments, features, and examples have been described herein, it will be understood by those skilled in the art that many aspects of the methods and devices shown and described in the present disclosure may be differently combined and/or modified to form still further embodiments. For example, any one component of the infusion sets shown and described above can be used alone or with other components without departing from the spirit of the present invention. Additionally, it will be recognized that the methods described herein may be practiced in different sequences, and/or with additional devices as desired. Such alternative embodiments and/or uses of the methods and devices described above and obvious modifications and equivalents thereof are intended to be included within the scope of the present invention. Thus, it is intended that the scope of the present invention should not be limited by the particular embodiments described above, but should be determined only by a fair reading of the claims that follow.

The invention claimed is:

1. A toothbrush comprising:

a handle with an internal cavity, the internal cavity being sealed in a substantially fluid tight manner;

a light generation mechanism configured to be fully assembled prior to at least partial insertion into the internal cavity comprising:

one or more elongate members;

a battery connected to and fixed in position with respect to the one or more elongate members;

a switch electrically coupled to the battery;

a light electrically coupled to the switch, wherein the switch and the light are coupled to the one or more elongate members such that the light generation mechanism is configured to be fully assembled in a self-contained manner prior to insertion into the internal cavity;

a head having a plurality of bristles, the head connected to the handle;

a pliant material of a material different from the handle and connected to the handle, wherein the pliant material covers the switch such that a force applied on the pliant material is configured to flex the pliant material and cause the switch to activate the light; and wherein the one or more elongate members define a space within which the battery is disposed, the one or more elongate members extending adjacent to and along the full length of opposite longitudinal sides of the battery and adjacent to at least a portion of a top battery surface and a bottom battery surface, whereby the one or more elongate members assist in retaining the battery within the space.

2. The toothbrush of claim 1, wherein a longitudinal axis extends from the first end of the handle to the second end of the handle, the handle configured to have the light generation mechanism inserted into the interior internal cavity along the longitudinal axis in a direction towards the first end of the handle.

3. The toothbrush of claim 2, wherein the one or more elongate members extend in the direction of the longitudinal axis.

4. The toothbrush of claim 1, wherein the battery is positioned between the light and the switch.

5. The toothbrush of claim 1 including a circuit in electrical contact with the switch.

6. The toothbrush of claim 5 wherein the circuit is configured to cause the light to blink for a period of time.

7. The toothbrush of claim 1 including a motor positioned in the internal cavity and configured to produce motion of the plurality of bristles.

8. The toothbrush of claim 7 wherein the motion imparted to the bristles by the motor is at least one of oscillation, rotation and vibration.

9. The toothbrush of claim 1 wherein the handle has a first end and a second end, the head connected to the first end, and the internal cavity has a cavity opening from the second end.

10. A toothbrush comprising:

a handle having a first end and a second end opposite the first end, the handle defining an internal cavity, the second end defining an opening to the internal cavity;

a light generation mechanism inserted into the opening of the handle and extending into the internal cavity of the handle, the light generation mechanism comprising:

one or more elongate members;

a battery supported by and fixed in position with respect to the one or more elongate members;

a switch electrically coupled to the battery;

a light electrically coupled to the switch, wherein the switch and the light are supported by the one or more elongate members such that the light generation mechanism is configured to be fully assembled in a self-contained manner prior to at least partial insertion into the internal cavity;

a head having a plurality of bristles, the head connected to the handle;

a pliant material of a material different from the handle and connected to the handle, wherein the pliant material covers the switch such that a force applied on the pliant material flexes the pliant material and causes the switch to activate the light; and wherein the one or more elongate members define a space within which the battery is disposed, the one or more elongate members extending adjacent to and along the full length of opposite longitudinal sides of the battery and adjacent to at least a portion of a top battery surface and a bottom battery surface, whereby the one or more elongate members assist in retaining the battery within the space.

11. The toothbrush of claim 10, wherein each of the one or more elongate members extends along the length of the handle.

12. The toothbrush of claim 10, wherein the switch is configured to activate the light such that the light blinks for a period of time.

13. The toothbrush of claim 10, wherein the pliant material covers the switch such that the pliant material does not contact the switch when the pliant material is in an unstressed condition.

14. The toothbrush of claim 10, wherein the handle defines a longitudinal axis and the light generation mechanism is at least partially inserted into the opening of the internal cavity along the longitudinal axis.

15. The toothbrush of claim 10, wherein the pliant material provides a fluid tight seal of the internal cavity.

16. The toothbrush of claim 10, wherein the switch is operable via a post extending from a base.

17. The toothbrush of claim 16, wherein the switch is positioned such that the force applied on the pliant material flexes the pliant material and causes the post to move in a direction towards the base to activate the light.

18. The toothbrush of claim 17, wherein the switch is positioned such that the force applied on the pliant material moves the post in a direction towards the head of the toothbrush to activate the light.

19. The toothbrush of claim 17, wherein the pliant material surrounds at least a portion of the post.

20. The toothbrush of claim 19, wherein the pliant material is connected to the handle at an end of the handle opposite the head.

21. The toothbrush of claim 20, wherein the switch and the light are positioned on opposite sides of the battery.

22. The toothbrush of claim 21, wherein the switch extends outwardly away from the one or more elongate members.

23. A toothbrush comprising:

a handle having an interior cavity, with at least a portion of the handle being made of a flexible material;

a head coupled to the handle;

a plurality of bristles coupled to the head;

a power source positioned within the interior cavity; and a light generation mechanism extending into the interior cavity and configured to be fully assembled prior to insertion into the interior cavity, the light generation mechanism comprising:

one or more elongate members;

a light;

a circuit configured to provide the light with power from the power source; and a switch mechanism including a protrusion having a first end and a second end, with the first end of the protrusion extending away from the second end of the protrusion in a direction towards the flexible material such that the flexible material covers the first end of the protrusion, the first end of the protrusion being unconnected to the flexible material, the switch configured such that a force applied to the flexible material covering the first end of the protrusion moves the protrusion to complete the circuit to cause the light to blink for a period of time as set by the circuit, and the switch and the light are secured by the one or more elongate members such that the light generation mechanism is configured to be fully assembled in a self-contained manner prior to insertion into the interior cavity; and wherein the power source is fixed in position within the interior cavity such that the power source does not move when the protrusion moves to complete the circuit.

24. A toothbrush comprising:

a handle with an internal chamber, the internal chamber being sealed in a substantially fluid tight manner;

a light generation mechanism configured to be fully assembled prior to insertion into the internal chamber comprising:

a frame;

a battery fixed in position by the frame;

a printed circuit board;

an activation mechanism electrically coupled to the battery;

a light mounted on the printed circuit board and electrically coupled to the activation mechanism and the battery, wherein the light, the printed circuit board and at least a portion of the activation mechanism are secured by the frame such that the light generation mechanism is configured to be fully assembled in a self-contained manner prior to insertion of at least a portion of the light generation mechanism into the internal chamber;

a head having a plurality of bristles, the head connected to the handle;

a pliant material of a material different from the handle and connected to the handle, wherein the pliant material covers the portion of the activation mechanism such that a force applied on the pliant material is configured to flex the pliant material and cause the activation mechanism to activate the light; and wherein the handle has a first end and a second end, the head connected to the first end, and the internal chamber has a chamber opening from the second end, the light generation mechanism inserted into the opening;

wherein a longitudinal axis extends from the first end of the handle to the second end of the handle, the handle configured to have the light generation mechanism inserted into the internal chamber along the longitudinal axis in a direction towards the first end of the handle;

wherein the printed circuit board provides a circuit including a timer that is configured to cause the light to blink for a period of time;

wherein the toothbrush includes a motor positioned in the internal chamber and configured to produce motion of the plurality of bristles;

wherein the timer is operable to control the motor to operate for a period of time upon activation of the activation mechanism;

wherein the motion imparted to the bristles by the motor is at least one of oscillation, rotation and vibration.

25. The toothbrush of claim 24 wherein the activation mechanism includes a button that extends away from the printed circuit board, the button having a first end proximate the printed circuit board, wherein a force applied on the pliant material flexes the pliant material and causes actuation of the button.

26. The toothbrush of claim 25 wherein the activation mechanism includes a lever, wherein the force applied on the pliant material depresses the lever to also depress the button.

27. The toothbrush of claim 24 wherein the frame includes one or more prongs for engaging a side wall of the internal chamber and securing the frame in place within the internal chamber.

* * * * *